US006026255A

United States Patent [19]

Kizaki et al.

[11] Patent Number: 6,026,255

[45] Date of Patent: Feb. 15, 2000

[54] IMAGE FORMING APPARATUS

[75] Inventors: Osamu Kizaki, Saitama; Atsushi Sanpe, Kanagawa, both of Japan

[73] Assignee: Ricoh Company, Ltd., Tokyo, Japan

[21] Appl. No.: 08/976,334

[22] Filed: Nov. 21, 1997

[30] Foreign Application Priority Data

Nov. 22, 1996 [JP] Japan ..... 8-311889

[51] Int. Cl.[7] ..... G03G 15/00

[52] U.S. Cl. ..... 399/43; 399/71; 399/346

[58] Field of Search ..... 399/43, 71, 77, 399/78, 85, 99, 264, 273, 346, 350, 129, 351, 343

[56] References Cited

U.S. PATENT DOCUMENTS

| | | | |
|---|---|---|---|
| 4,969,015 | 11/1990 | Sanpe | 399/345 |
| 5,386,274 | 1/1995 | Sanpe et al. | 399/101 |
| 5,463,455 | 10/1995 | Pozniakas et al. | 399/350 |
| 5,493,382 | 2/1996 | Takagaki et al. | 399/359 |
| 5,663,788 | 9/1997 | Sanpe | 399/353 |

FOREIGN PATENT DOCUMENTS

| | | |
|---|---|---|
| 61-95381 | 5/1986 | Japan . |
| 1-108592 | 4/1989 | Japan . |
| 3-282486 | 12/1991 | Japan . |
| 8-6441 | 1/1996 | Japan . |
| 9-258534 | 10/1997 | Japan . |

*Primary Examiner*—William Royer
*Assistant Examiner*—William A. Noe
*Attorney, Agent, or Firm*—Oblon, Spivak, McClelland, Maier & Neustadt, P.C.

[57] ABSTRACT

An image forming apparatus including a blade for removing a developer left on a photoconductive drum. In addition, a low density pattern is formed on at least a part of the photoconductive drum based on a duration the photoconductive drum is driven.

16 Claims, 6 Drawing Sheets

START
S1
REQUEST FOR NON-IMAGE FORMING MODE ?
N
Y
RET
S2
SET f SET PATTERN & CLEAR t TO ZERO
S3
END OF NON-IMAGE FORMING MODE ?
Y
N
S4
NON-IMAGE FORMING MODE END PROCESSING
RET
S5
NON-IMAGE FORMING MODE PROCESSING

IMAGE FORMING APPARATUS

BACKGROUND OF THE INVENTION

The present invention relates to a copier, printer, facsimile apparatus or similar image forming apparatus of the type including a blade for removing a developer left on a photoconductive element or similar image carrier.

An image forming apparatus of the kind described includes a photoconductive drum or similar image carrier driven by drive means. Latent image forming means uniformly charges the surface of the drum and then exposes it in accordance with a document image or an image signal, thereby forming a latent image on the drum. A developing device develops the latent image with a developer to thereby produce a corresponding toner image. An image transferring device transfers the toner image from the drum to a paper or similar recording medium. A cleaning device removes the developer left on the drum after the image transfer. A fixing device fixes the toner image on the recording medium.

While a heat roller and a press roller included in the fixing device are rotated by a drive source, at least the heat roller is heated by a heater. As a result, when the paper is brought to a nip between the two rollers, the toner image is fixed on the paper by heat and pressure. In a high-speed image forming apparatus whose heat roller has a substantial wall thickness, the heat roller and press roller are rotated in a preliminary rotation mode after the power-on of the apparatus, but before the beginning of image formation. This evenly distributes the surface temperature of the heat roller. Usually, during the preliminary rotation mode relating to fixation, the developing device is not operated. In addition, in this mode of operation, the heat roller and press roller are continuously rotated for a long period of time (sometimes more than 5 minutes).

The cleaning device is often implemented by a blade cleaning scheme using a blade. The blade is held in contact with the photoconductive drum in order to scrape off the developer left on the drum after the image transfer. The problem with this type of cleaning device is that friction acting between the drum and the blade is apt to cause the blade to be turned over or chipped, resulting in defective images. To solve this problem, toner must be fed between the drum and the blade for enhancing lubrication. Various methods have heretofore been proposed to feed toner between the drum and the blade in an image forming mode in which an image is formed in the usual manner. However, a method of feeding toner between the drum and the blade in a non-image forming mode in which no images are formed has rarely been proposed.

Japanese Patent Laid-Open Publication No. 62-34172 teaches a method of feeding toner between the drum and the blade in the non-image forming mode. The object of this method is to make it needless to apply a lubricant around the drum when the drum is mounted to the apparatus. Specifically, a black solid image is formed over one half or the entire periphery of the drum and fed to the above position.

Japanese Patent Laid-Open Publication No. 61-95381 discloses a cleaning device for an image forming apparatus and including a cleaning blade movable into and out of contact with the surface of an image carrier. Only when a single image forming operation is not followed by the next image forming operation within a preselected period of time, the cleaning device is controlled such that toner is deposited on the surface of the image carrier before the subsequent image forming operation. Specifically, the above document teaches that a bias for development is applied to cause toner to deposit on the image carrier, and that some positively charged toner, which exists in negatively or regular charged toner is transferred to the image carrier by the bias for development.

Japanese Patent Laid-Open Publication No. 3-282486 proposes an image forming apparatus including an image carrier for forming a toner image thereon, drive means for driving the image carrier, nonvolatile store means for storing the duration of drive transmission from the drive means to the image carrier, and display means for urging the operator to replace the image carrier when the duration stored in the store means coincides with a preselected period of time.

Japanese Patent Laid-Open Publication No. 1-108592 pertains to a blade lubrication maintaining device of the type depositing toner on an image carrier between the end of a series of image forming cycles and the stop of an apparatus and thereby feeding it to a blade. The device is characterized in that toner amount control means is provided for controlling the amount of toner to deposit on the image carrier in accordance with the number of image forming cycles. This document teaches that the area of the image carrier for the toner to deposit or the density of the toner to deposit is controlled in accordance with the number of image forming cycles.

Further, Japanese Patent Laid-Open Publication No. 63-138369 relates to an electrostatic copier including an electrophotographic photoconductive element movable in a preselected direction, a corona discharger for charging the surface of the photoconductive element to a particular polarity, optics for projecting a document image onto the surface of the drum, a developing device for developing a latent image formed on the surface of the photoconductive element to thereby produce a corresponding toner image, predischarging means positioned upstream of the developing device in the above direction in order to dissipate the charge of the photoconductive element, a cleaning device including a n elastic blade for removing toner left on the photoconductive element after image transfer, and control means for controlling the predischarging means. The copier taught in the above document is characterized in that the control means controls the predischarging means such that toner slightly deposits on the photoconductive element over substantially the entire width of a non-image area where a toner image is not formed. Specifically, the predischarging means is implemented by a plurality of lamps arranged in the widthwise direction of the photoconductive element. The control means selectively turns off the lamps corresponding to the non-image area for a short period of time, so that toner slightly deposits on the above area of the photoconductive element due to charge left on the same area.

The method taught in the abovementioned Laid-Open Publication No. 62-34172 feeds toner between the drum and the blade during non-image formation. Therefore, this kind of toner feed occurs when frictional resistance between the drum and the blade is great, e.g., when the drum is newly mounted to the apparatus or replaced. Such a scheme is extremely effective when is rarely executed. However, assume that the toner is frequently fed, e.g., in the preliminary rotation mode occurring every time the fixing temperature is lower than a preselected temperature at the time of power-up of the apparatus; because development does not occur, the blade is likely to be turned over due to the absence of toner between the drum and the blade and the long duration of rotation of the heat roller and press roller. Then, there are brought about the scattering of toner, defective cleaning of the drum, and wasteful toner consumption. In addition, when charging means for charging the drum is implemented as a charge roller contacting the drum, the defective cleaning of the drum, for example, results in the smearing of the charge roller and therefore defective images.

Technologies relating to the present invention are also disclosed in, e.g., Japanese Patent Laid-Open Publication No. 8-6441.

SUMMARY OF THE INVENTION

It is therefore an object of the present invention to provide an image forming apparatus capable of feeding toner adequately between an image carrier and a blade even in, e.g., a preliminary rotation mode relating to fixation and which is frequently executed in a non-image forming mode.

It is another object of the present invention to provide an image forming apparatus capable of preventing its blade from being turned over or broken.

It is another object of the present invention to provide an image forming apparatus capable of forming a low density pattern with a minimum amount of toner.

It is another object of the present invention to provide an image forming apparatus capable of detecting the amount of toner fed in a non-image forming mode, and controlling the amount of toner to be fed.

It is another object of the present invention to provide an image forming apparatus capable of varying the amount of toner to be fed, and reducing it.

It is another object of the present invention to provide an image forming apparatus preventing its blade from being turned over even when the blade and a photoconductive element are new.

It is another object of the present invention to provide an image forming apparatus capable of forming a low density pattern while preventing its belt from meandering or becoming offset.

An image forming apparatus of the present invention includes an image carrier and a drive source for moving the image carrier by driving it. A latent image forming section forms a latent image on the image carrier by charging and then exposing it. A developing device develops the latent image to thereby produce a corresponding toner image. An image transferring device transfers the toner image from the image carrier to a recording medium. A cleaning device removes a developer left on the image carrier after image transfer. A drive duration counting device counts the duration of drive of the image carrier. A pattern forming device forms, based on the period of time counted by the drive duration counting device, a density pattern on at least a part of the surface of the image carrier.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
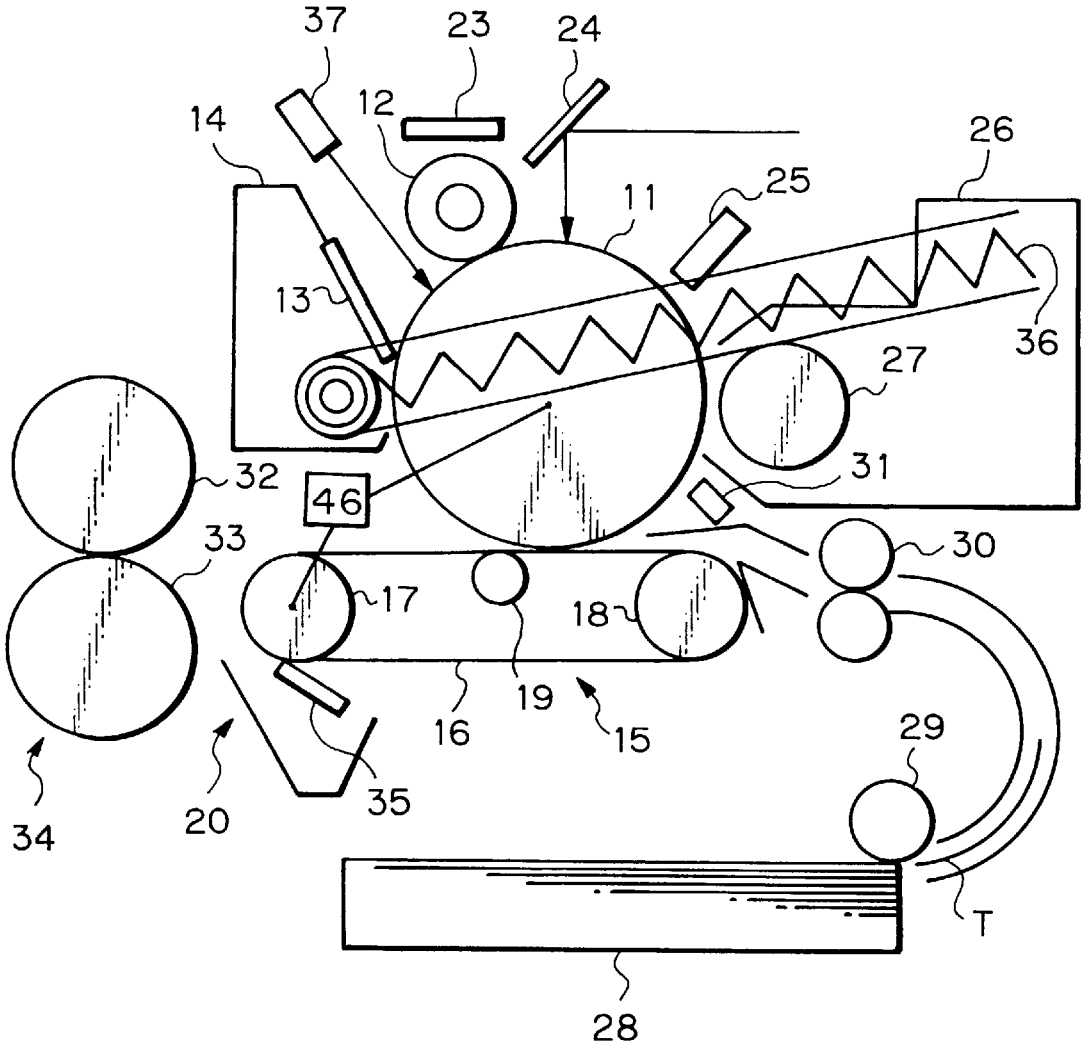
FIG. 1 is a section showing an image forming apparatus embodying the present invention.

Referring to FIG. 1 of the drawings, an image forming apparatus embodying the present invention is shown and implemented as a copier by way of example. As shown, the copier includes an image carrier in the form of a photoconductive element 11. A charging device includes a charge roller 12 rotatable in contact with the element 11. A cleaning device 14 includes a cleaning blade 13 capable of cleaning the surface of the photoconductive element 11 in sliding contact with the element 11. A transfer belt device 15 plays the role of image transferring means.

The transfer belt device 15 includes a belt 16 passed over a drive roller 17 and a driven roller 18. A main motor or drive means 46 (see FIG. 2) causes the belt 16 to turn counterclockwise, as viewed in FIG. 1, via the drive roller 17. A belt high-tension power source 21 (see FIG. 2) applies a high voltage to a bias roller or electrode 19, so that a bias for image transfer is applied to the belt 16. A cleaning device 20 cleans the belt 16 at a position downstream of a paper separating position, which will be described, with respect to the direction of rotation of the belt 16.

In the illustrative embodiment, the photoconductive element 11 is implemented as a drum having an OPC (Organic Photo Conductor) or similar photoconductive layer by way of example. In an ordinary image forming mode, the charge roller 12 uniformly charges the surface of the drum 11. Specifically, a roller high-tension power source 22 (see FIG. 2) applies a high voltage to the charge roller 12 so as to deposit a uniform charge on the surface of the drum 11. A cleaner 23 cleans the surface of the charge roller 12.

An exposing device exposes the charged surface of the drum 11 imagewise, thereby electrostatically forming a latent image thereon. Specifically, the exposing device includes a halogen lamp or similar light source, and mirrors including a mirror 24. While the light source illuminates a document laid on a glass platen, the resulting reflection is projected onto the drum 11 via the mirrors. The light source and a part of the mirrors move while sequentially scanning the document. As a result, a latent image representative of the image of the document is formed on the drum 11; a negative charge deposited on the drum 11 disappears in accordance with the intensity distribution of the imagewise reflection incident to the drum 11. If desired, the exposing device may be of the type exposing the drum 11 in accordance with an image signal.

An eraser 25 is implemented by lamps and illuminates needless portions of the latent image formed on the drum 11 so as to dissipate the charge deposited in such portions. The needless portions mentioned above include a portion of the latent image outside of a paper area. A developing device 26 accommodates a developer therein. A developing sleeve 27 is rotated to convey the developer to a developing position between the drum 11 and the sleeve 27. At the developing position, toner contained in the developer is transferred from the sleeve 27 to the drum 11, developing the latent image. As a result, the latent image turns out a toner image.

A paper or similar recording medium T is fed from a paper feeder 28 to a registration roller pair 30 by a pick-up roller 29. The paper T is stopped on abutting against the nip of the registration roller pair 30. While the toner image on the drum 11 is conveyed toward the belt 16 by the drum 11, a pretransfer discharger (PTL) 31 optically discharges the drum 11 in order to increase an image transfer efficiency. The registration roller pair 30 drives the paper T such that the leading edge of the paper T meets the leading edge of the toner image.

The belt 16 conveys the paper T toward a nip between the drum 11 and the belt 16. As soon as the leading edge of the paper T arrives at the above nip, the belt high-tension power source 21 applies a bias for image transfer to the bias roller 19. Consequently, a charge opposite in polarity to the toner carried on the drum 11 is deposited on the paper T, causing the toner image to be transferred from the drum 11 to the paper T. The paper T with the toner image is separated from the belt 16 at a paper separating position where the drive roller 17 is located. Subsequently, a heat roller 32 and a press roller 33 constituting a fixing device 34 fix the toner image on the paper T. The paper T coming out of the fixing device 34 is driven out of the copier.

The heat roller 32 and press roller 33 are driven by a drive source while being pressed against each other. The rollers 32 and 33 fix the toner image on the paper T being passed through their nip by applying heat and pressure to the paper T. While the heat roller 32 is heated by a heater, a temperature sensor senses the surface temperature of the roller 32 and sends its output to a temperature control section. In response, the temperature control section controls a current to be fed from an AC power source to the heater such that the surface of the heat roller 32 is held at a preselected temperature.

The cleaning device assigned to the belt 16 includes a cleaning blade 35 contacting the belt 16 at the particular position mentioned earlier. The cleaning blade 35 and the cleaning blade 13 of the cleaning device 14 each is formed of polyurethane rubber. The surface of the belt 16 is coated with fluorine (vinylidene polyfluoride), so that a coefficient of friction between the belt 16 and the blade 35 is sufficiently small. The blade 35 removes toner, paper dust and other impurities remaining on the belt 16. The impurities removed by the blade 35 are collected in a collecting portion below the blade 35.

The cleaning blade 13 of the cleaning device 14 removes toner left on the drum 11 after the transfer of the toner image to the paper T. The toner removed from the drum 11 is returned to the casing 26 of the developing device by a spiral 36 disposed in a piping. Finally, a discharge lamp (QL) 37 illuminates the entire surface of the drum 11 so as to dissipate the charge left thereon and thereby prepares the drum 11 for the next image formation.

In the ordinary image forming mode, the above image forming procedure is repeated a number of times corresponding to a desired number of copies. Usually, during an interval between the power-on of the copier and the start of image formation, the heat roller 32 and press roller 33 are subjected to preliminary rotation in a preliminary rotation mode. In the preliminary rotation mode, the developing device does not perform development, and the two rollers 32 and 33 are rotated for a substantial period of time.

Figure 2:
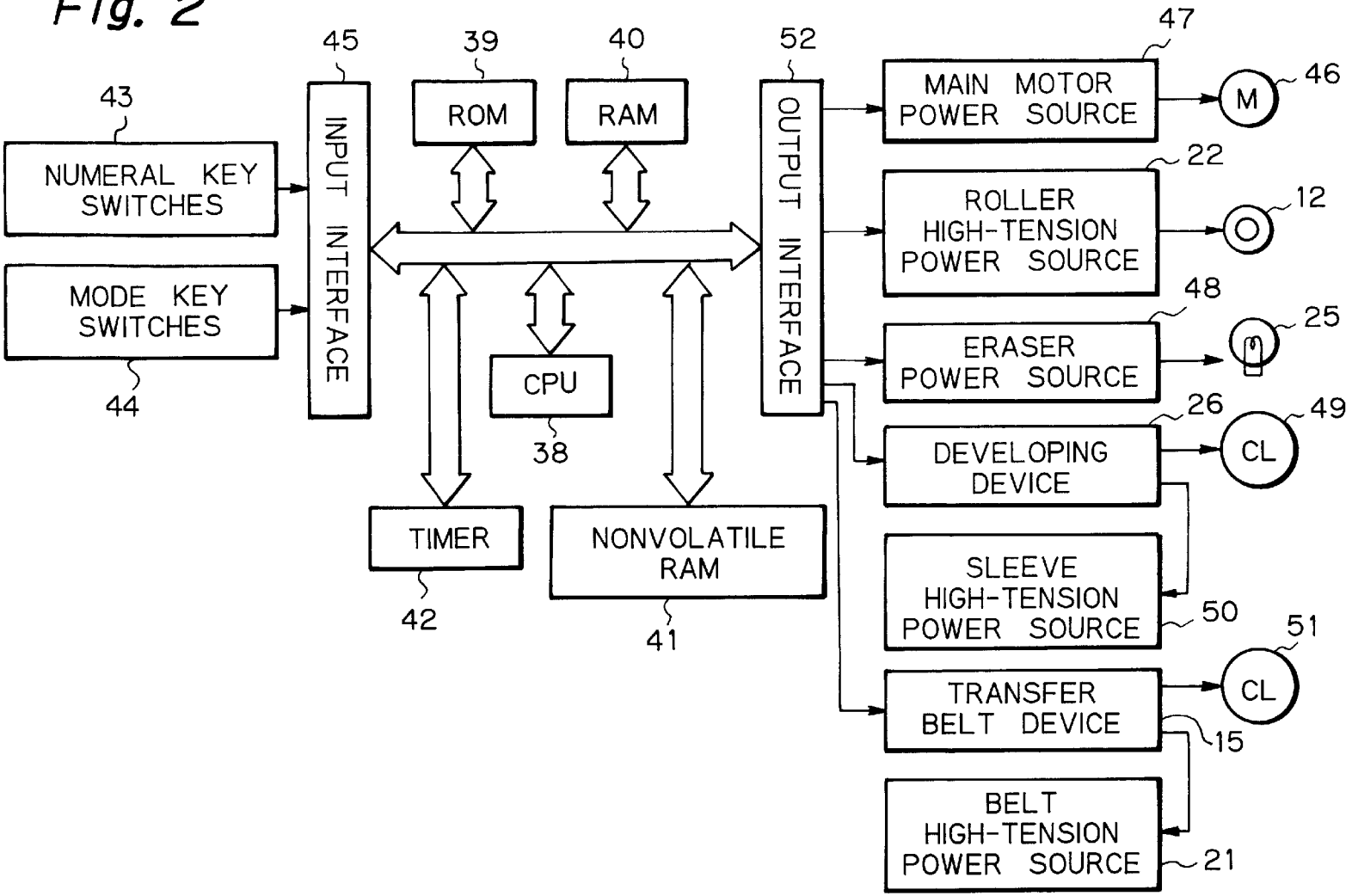
FIG. 2 is a block diagram schematically showing a toner feed control system included in the embodiment.

FIG. 2 shows the basic configuration of a toner feed control system included in the illustrative embodiment. As shown, the toner feed control system includes a CPU (Central Processing Unit) 38 playing the role of control means for totally controlling the system. A ROM (Read Only Memory) 39 stores a program to be executed by the CPU 38. A RAM (Random Access Memory) 40 is usable as a work area. A nonvolatile RAM 41 stores data written thereto even when a power switch provided on the copier is turned off. The reference numeral 42 designates a timer.

Numeral key switches 43 and mode switches 44 are arranged on an operation panel included in the copier. The outputs of these switches 43 and 44 are sent to the CPU 38 via an input interface 45. The CPU 38 is therefore capable of identifying various kinds of modes available with the copier and various copying conditions including a desired number of copies. The main motor 46 for driving the drum 11 as well as other elements is driven by a main motor power source 47. The eraser 25 is driven by an eraser power source 48.

When a clutch (CL) 49 assigned to the developing device 26 is coupled, it connects the developing sleeve 26 to the drive source. A sleeve high-tension power source 50 applies a bias for development to the developing sleeve 26 being rotated. A CL 51 is associated with a belt moving mechanism, not shown. The belt moving mechanism brings the belt 16 into contact with the drum 11 when the CL 51 is coupled or brings the former out of contact with the latter when the CL 51 is uncoupled.

The main motor power source 47, roller high-tension power source 22, eraser power source 48, CL 49 for development, sleeve high-tension power source 50, CL 51 for the movement of the belt 16 and belt high-tension power source 21 are individually controlled by control signals fed from the CPU 38 via an output interface 52. The control signals relate to the formation of a toner image on the drum 11 and the transfer of the toner image to the paper T.

Figure 3:
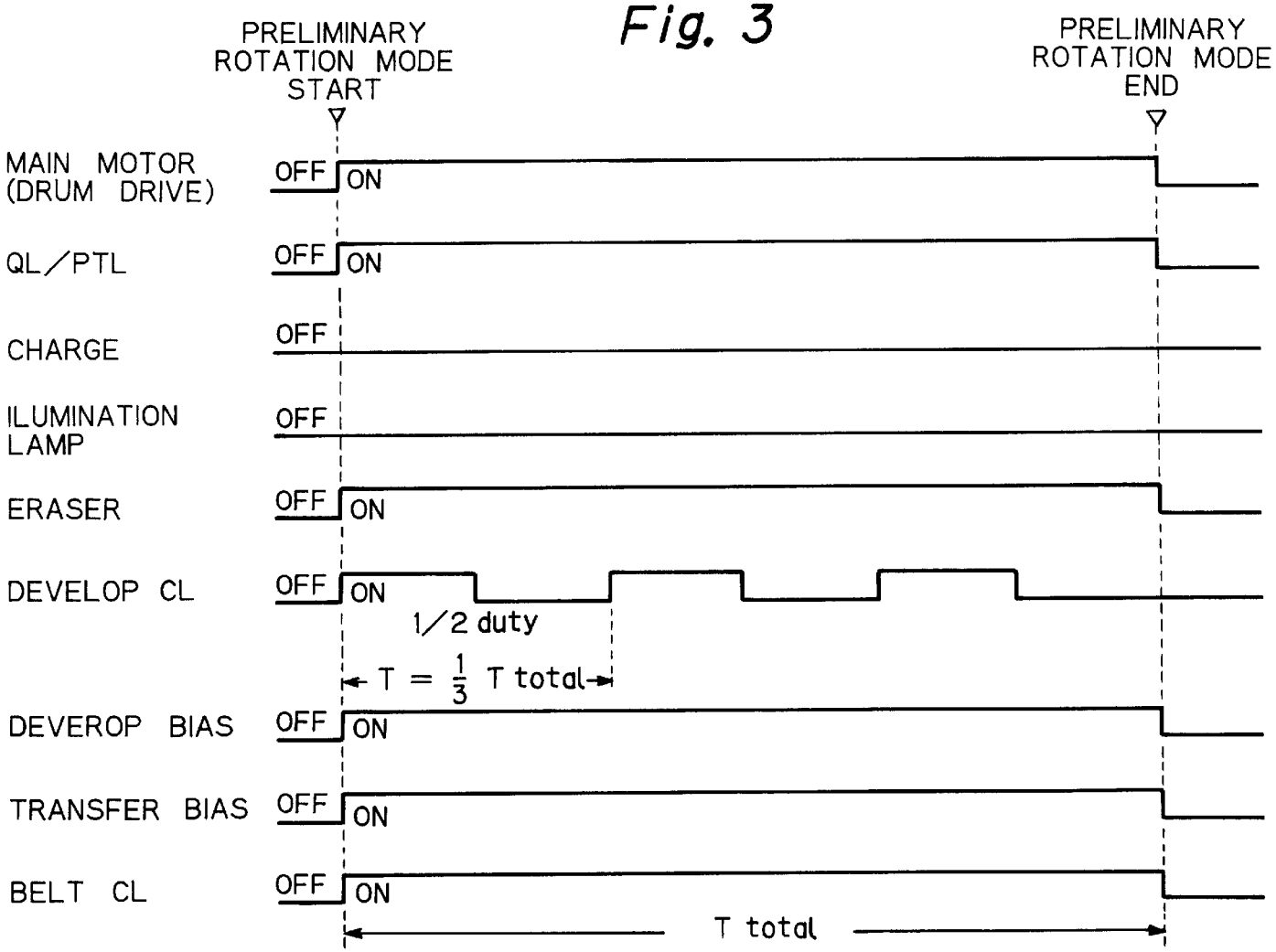
FIG. 3 is a timing chart demonstrating the operation of the embodiment to occur in a preliminary rotation mode relating to fixation.
Figures 4, 4A, 4B:
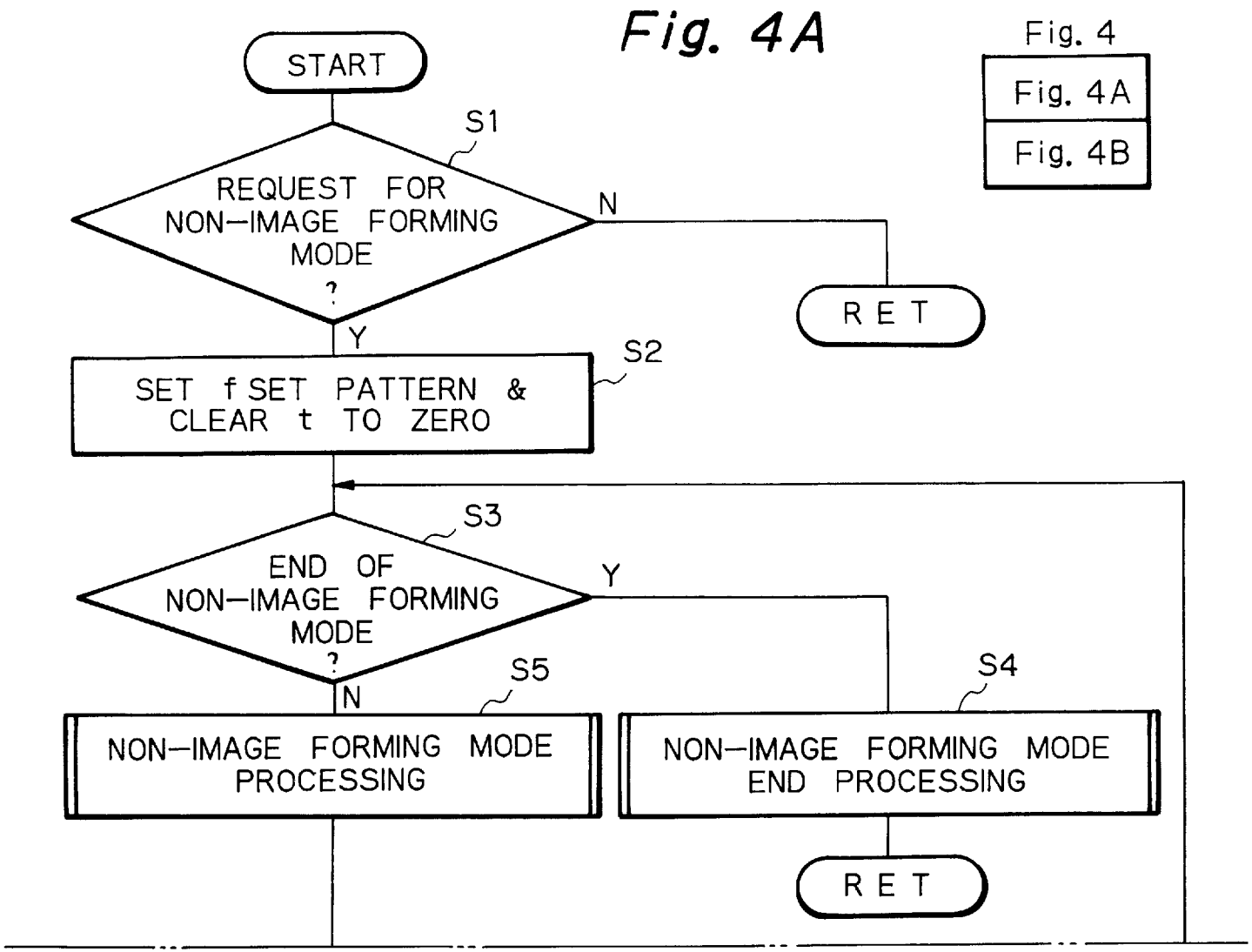
FIG. 4 is a flowchart demonstrating a part of processing to be executed by a CPU (Central Processing Unit) included in the embodiment.
Figure 4B:
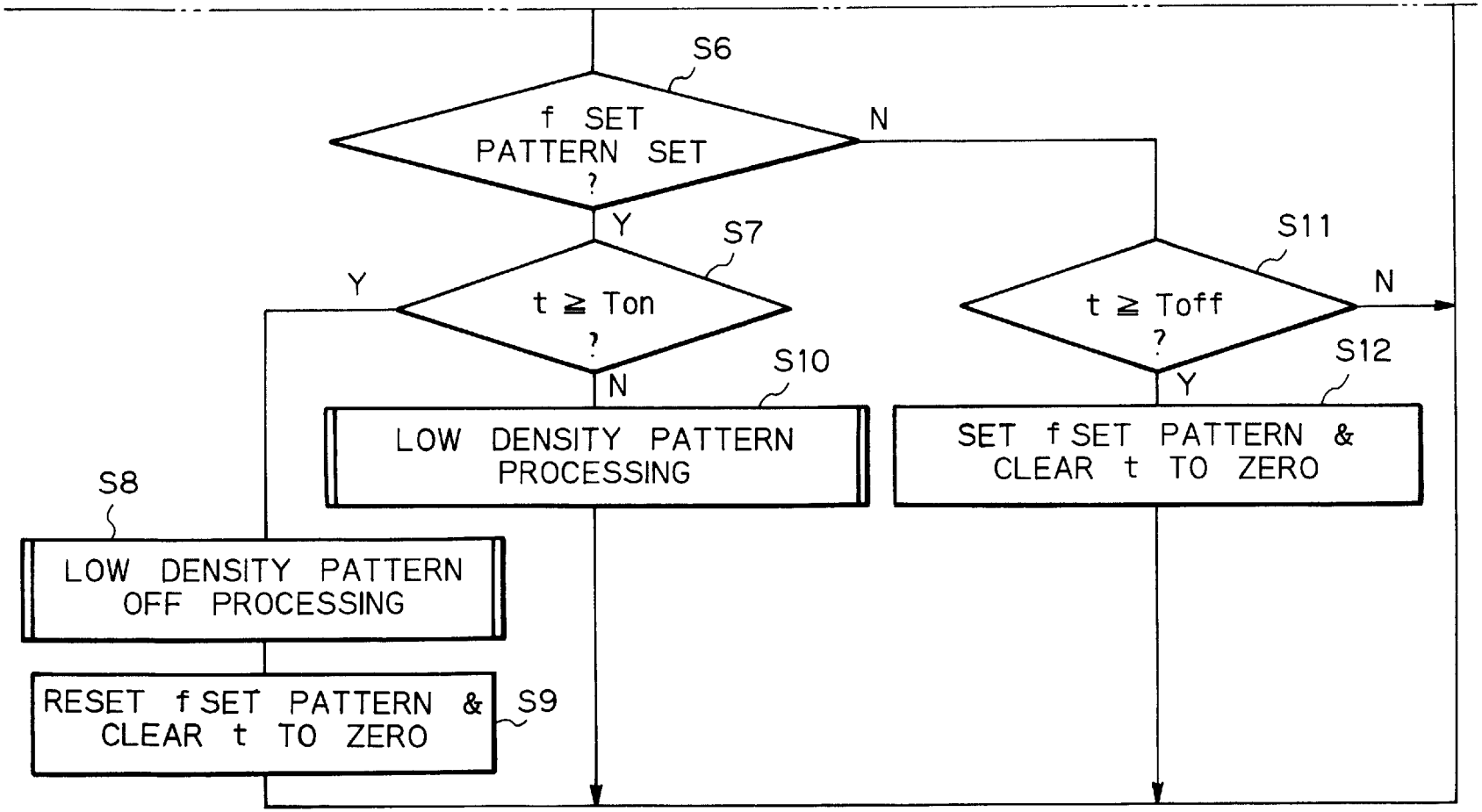

Reference will be made to FIGS. 3 and 4 for describing the preliminary rotation mode relating to the fixing device 34. As shown, the CPU 38 determines whether or not a request for a non-image forming mode is present (step S1). The words "non-image forming mode" refer to a mode in which the drum 11 is rotated and image formation does not occur, but different from the usual image forming mode in which the drum is driven and image formation occurs. Specifically, the non-image forming mode refers to, e.g., the preliminary rotation mode relating to fixation.

If the answer of the step S1 is negative (N), the CPU 38 returns. If the answer of the step S1 is positive (Y), the CPU 38 sets a flag fSet Pattern (step S2) and clears a variable t to zero. The variable t is counted up by the timer 42 at a preselected timing. Subsequently, the CPU 38 determines whether or not the non-image forming mode has ended (step S3). If the answer of the step S3 is N, the CPU 38 executes or continues to execute the non-image forming mode (e.g. preliminary rotation mode) (step S5). The step S5 is followed by a step S6.

In the step S6, the CPU 38 determines whether or not the flag fSet Pattern is set. If the answer of the step S6 is Y, the CPU 38 determines whether or not the variable t has reached a preselected period of time Ton (step S7). If the answer of the step S7 is N, meaning that the variable t is short of the preselected period of time Ton, the CPU 38 executes a low density pattern forming procedure, which will be described, (step S10) and then returns to the step S3. If the answer of the step S7 is Y, the CPU 38 executes a low density pattern OFF procedure, which will also be described, (step S8), resets the flag fSet Pattern (step S9), clears the variable t to zero, and then returns to the step S3.

If the flag fSet Pattern is reset (N, step S6), the CPU 38 determines whether or not the variable t has reached the preselected period of time Toff (step S11). If the answer of the step S11 is N, the CPU 38 returns to the step S3. Further, if the answer of the step S3 is Y, meaning that the non-image forming mode has ended, the CPU 38 executes a procedure for ending the mode (step S4) and then returns.

As stated above, by use of the variable t to be counted up by the timer 42 at a preselected timing, the CPU 38 executes low density pattern formation (step S10) for the preselected period of time Ton and then executes low density pattern non-formation for the period of time Toff.

Thereafter, the CPU 38 executes such formation and non-formation alternately.

The periods of times or durations Ton and Toff are expressed as:

$$Ton=(Ttotal/N)*d$$

$$Toff=(Ttotal/N)*(1-d)$$

where Ttotal denotes the total duration of the non-image forming mode, N denotes a natural number giving (Ton+Toff)*N=Ttotal, and d denotes a number representative of the ratio of Ton to one period. The CPU 38 executes the low density pattern formation and low density pattern non-formation alternately by using 1/N of the total duration of the non-image forming mode as one period.

It is therefore possible to detect and control the amount of toner fed during the non-image forming mode. Further, the CPU 38 is capable of varying the amount of toner to be fed by varying the duty ratio between the pattern formation and the pattern non-formation, and capable of reducing it.

During each period, i.e., 1/N of the total duration of the non-image forming mode, the low density pattern formation and low density pattern non-formation are sequentially executed in this order; that is, toner is fed at first. Therefore, the cleaning blade 13 is prevented from being turned over at the time of, e.g., a forming operation performed when a photoconductive element is newly mounted or replaced. The frictional resistance between the drum 11 and the blade 13 is particularly high during the forming operation.

The low density pattern formation (step S10) and non-formation (step S8) will be described, taking the preliminary rotation mode relating to fixation as an example. Generally, a high-speed image forming apparatus includes a heat roller whose wall is thick. It is a common practice with this kind of apparatus to effect, e.g., the preliminary rotation of the heat roller and press roller in a preliminary rotation mode between the power-on of the apparatus and the beginning of image formation. Usually, in the preliminary rotation mode, a developing device does not perform development, and no toner is fed to a photoconductive element and a cleaning blade contacting each other. In the preliminary rotation mode, it is likely that the cleaning blade is turned over because the heat roller and press roller are rotated for a long period of time.

The preliminary rotation mode is executed on the power-up of the apparatus and when the fixing temperature falls below a preselected temperature. When the main motor 46 is driven, it causes the drum 11 to rotate. As a result, friction occurs between the drum 11 and the cleaning blade 13. If this condition continues, there is a fear that the blade 13 is turned over.

In light of the above, as shown in FIG. 3, the CPU 38 turns on the QL 37 and PTL 31 in synchronism with the main motor 47, turns on the entire eraser 25 (a plurality of lamps arranged in the axial direction of the drum 11), and turns off the roller high-tension power source 22 in order to cause the charge roller 12 to stop charging the drum 11. As a result, the drum 11 is brought to a non-charged state. It is to be noted that only the stop of charging of the charge roller 12 or only the turn-on of the eraser 25 may be effected.

Figure 5:
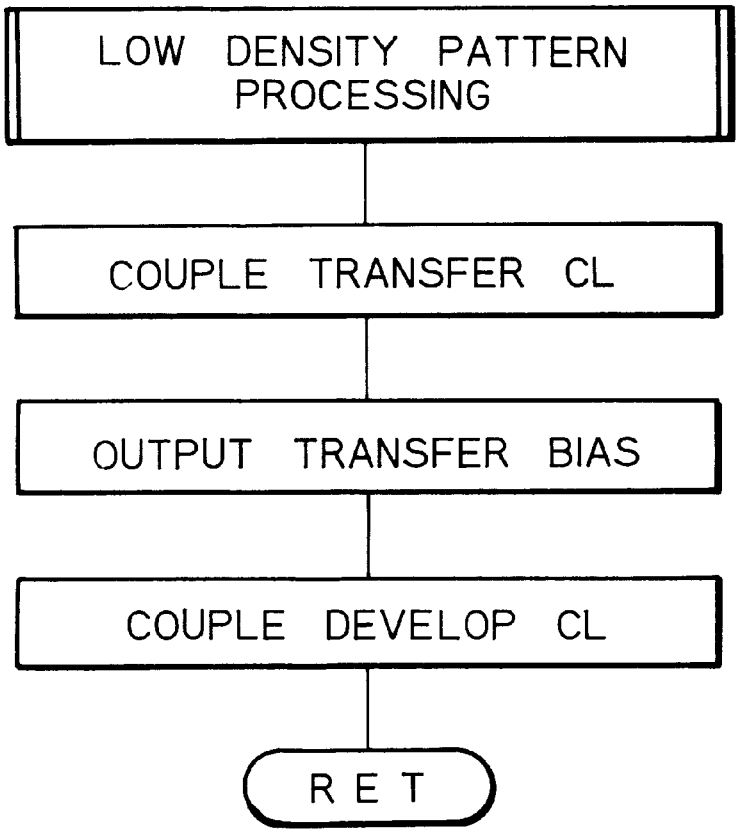
FIG. 5 is a flowchart showing a part of the processing of FIG. 4 in detail.
Figure 6:
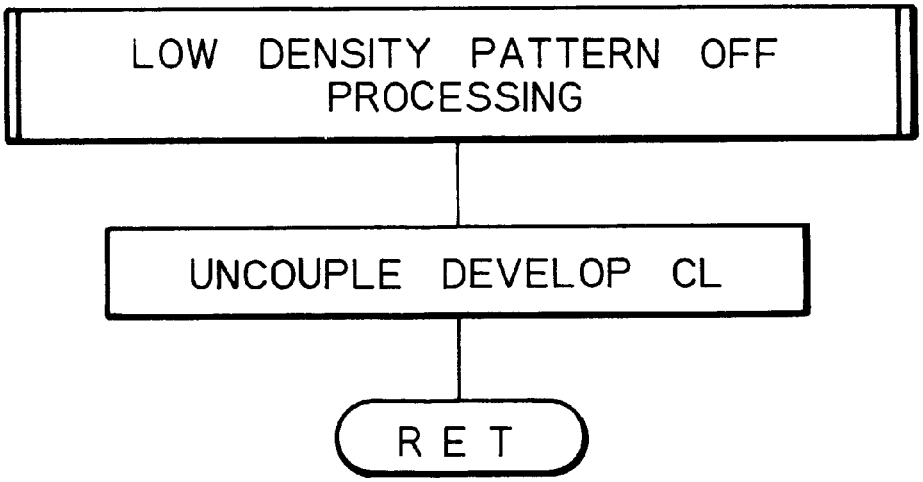
FIG. 6 is a flowchart showing another part of the processing of FIG. 4 in detail.

In the above condition, the CPU 38 causes a low density pattern to be formed in the step S10. Specifically, as shown in FIG. 5, the CPU 38 causes the sleeve high-tension power source 50 to apply a bias for development to the developing sleeve 27 and couples the CL 49 for development. Consequently, toner opposite in polarity to the toner of regular polarity contained in the developer stored in the developing device 26 or weakly charged toner is deposited on the drum 11, forming a low density pattern.

More specifically, while most of the toner of the developer stored in the developing device 26 is charged to, e.g., positive polarity, some toner charged to negative polarity and weakly charged toner also exist in the developer. That is, although toner particles are usually charged to positive polarity due to friction acting between it and carrier particles (negative polarity), the toner particles (positive polarity) are partly charged to negative polarity due to friction acting between themselves. Such toner particles of negative polarity or weakly charged toner particles are deposited on the drum 11, forming a low density pattern. Consequently, a small amount of toner is fed to the cleaning blade 13 in the form of the low density pattern.

In the illustrative embodiment, the image transferring device is implemented by the transfer belt device 15. Assume that the belt 16 is continuously rotated without contacting the drum 11. Then, it is likely that the belt 16 meanders or becomes offset and consequently waves or, in the worst case, breaks. This lowers the image transfer ability of a part of the transfer belt device 15 or causes the cleaning blade 35 to be turned over. To obviate such an occurrence, as shown in FIG. 5, the CPU 38 turns on the CL 51 in order to bring the belt 16 into contact with the drum 11 during the low density pattern formation of the step S10.

Further, assume that the belt 16 is brought into contact with the drum 11 without the bias for image transfer being applied to the belt 16. Then, it is likely that the toner opposite in polarity to the toner transferred from the developing device 26 to the drum 11 is transferred to the belt 16, critically smearing the surface of the belt 16. In light of this, as shown in FIG. 5, the CPU 38 causes the belt high-tension power source 21 to apply the bias of regular polarity for image transfer to the belt 16 via the bias roller 19 during the low density pattern formation of step S10. As a result, while the belt 16 is held in contact with the drum 11, the toner opposite in polarity to the toner of regular polarity deposited on the drum 11 is surely fed to the cleaning blade 13 without being transferred to the belt 16.

Of the conclusion of the low density image formation process, step S8 caused CPU to uncouple the CL 49 for development.

In summary, the above embodiment includes the photoconductive drum 11 playing the role of an image carrier. The main motor or drive means 46 drives the image carrier 11. The charge roller 12 and exposing means constitute latent image forming means for forming a latent image on the image carrier 11 by charging and then exposing the image carrier 11. The developing device or developing means 26 develops the latent image to thereby produce a corresponding toner image. The transfer belt device or image transferring means 15 transfers the toner image from the image carrier 11 to a paper or similar recording medium T. The cleaning device 14 includes the blade 13 for removing a developer remaining on the image carrier 11 after the image transfer. The timer 42 for counting the duration of drive of the image carrier 11 constitutes drive duration counting means 42. The CPU 38, ROM 39 and RAM 40 constitute time comparing means for determining which of the duration counted by the timer 42 and a preselected duration is greater. Also, the CPU 38, ROM 39 and RAM 40 constitute pattern forming means for causing a low density pattern to be formed on at least a part of the surface of the image carrier 11. When, e.g., a preliminary rotation mode relating to fixation and to be frequency executed is executed in a non-image forming mode, toner can be adequately fed to between the image carrier 11 and the blade 13. This prevents the blade 13 from being turned over or broken.

Computing means (CPU 38, ROM 39 and RAM 40) is provided for causing, while the drive means 46 is driving the image carrier in the non-image forming mode, the drive duration counting means 42 to operate and causing the pattern forming means to operate on the basis of the output of the drive duration counting means 42. This is also successful to achieve the above advantage. In addition, the low density pattern can be formed by a minimum amount of toner. 1/N (N being a natural number) of a period of time necessary for the non-image forming mode is selected to be one period. The pattern forming means has its duty ratio between operation and non-operation rendered variable within one period. Computing means (CPU 38, ROM 39 and RAM 40) is provided for determining the duration of pattern formation and that of pattern non-formation by using the following equations:

duration of formation: $Ton=(Ttotal/N)*d$ duration of non-formation: $Toff=(Ttotal/N)*(1-d)$ where Ttotal denotes the total duration of the non-image forming mode, N denotes a natural number giving (Ton+Toff)*N=Ttotal, and d denotes a number representative of the ratio of Ton to one period. This is also successful to prevent the blade 13 from being turned over or broken during, e.g., the preliminary rotation mode relating to fixation and executed frequently. Further, it is possible to detect and control the amount of toner fed during the non-image forming mode. In addition, the amount of toner to be fed can be controlled by varying the duty ratio between the pattern formation and the pattern non-formation, and the amount of toner to be fed can be reduced.

During one period stated above, the pattern forming means is rendered operative first and then rendered inoperative. Therefore, the blade 13 can be prevented from being turned over even when the image carrier 11 and blade 13 are new.

The pattern forming means forms the low density pattern on the non-charged image carrier 11 when a bias for development is applied to the developing device 26. This also successfully prevents the blade 13 from being turned over or broken.

The image transferring means 15 includes the belt 16 for transferring the toner image from the image carrier 11 to the recording medium T. While the belt 16 is held in contact with the image carrier 11, the pattern forming means forms the low density pattern on the image carrier 11 by applying the bias to the developing means 26 and by applying a bias for image transfer to the image transferring means 15. This not only prevents the belt 16 from being turned over or broken, but also prevents it from meandering or becoming offset.

Various modifications will become possible for those skilled in the art after receiving the teachings of the present disclosure without departing from the scope thereof.

What is claimed is:

1. An image forming apparatus comprising:

an image carrier;

drive means for driving said image carrier;

latent image forming means for forming a latent image on said image carrier by charging and then exposing said image carrier;

developing means for developing the latent image to thereby produce a corresponding toner image;

image transferring means for transferring the toner image from said image carrier to a recording medium;

a cleaning device for removing a developer left on said image carrier after image transfer;

drive duration counting means for counting a duration said image carrier is driven by said drive means; and pattern forming means for forming, based on a period of time counted by said drive duration counting means, a density pattern on at least a part of a surface of said image carrier.

2. An apparatus as claimed in claim 1, further comprising duration comparing means for determining which of the duration counted by said drive duration counting means and a preselected duration is greater.

3. An apparatus as claimed in claim 2, wherein said density pattern comprises a low density pattern.

4. An apparatus as claimed in claim 3, further comprising means for causing, in a non-image forming mode in which image formation does not occur and while said drive means is driving said image carrier, said drive duration counting means to operate and means for causing, based on the duration counted by said drive duration counting means, said pattern forming means to operate.

5. An apparatus as claimed in claim 4, wherein the non-image forming mode includes a duration Ttotal having a natural number N of periods, each period including an interval of pattern formation, Ton, and an interval of pattern non-formation, Toff, the apparatus further comprising:

means for determining a duration of said interval of pattern formation, Ton, and a duration of said interval of non-formation, Toff, according to the equations:

$Ton=(Ttotal/N)\times d$, and $Toff=(Ttotal/N)\times(1-d)$ where d is a duty ratio of said pattern forming means, said duty ratio defined as the ratio of Ton to the duration of one period (Ttotal/N); and means for varying said duty ratio.

6. An apparatus as claimed in claim 5, wherein in each period, said pattern forming means is rendered operative first and then rendered inoperative.

7. An apparatus as claimed in claim 4, wherein said pattern forming means forms said low density pattern on said image carrier by applying a bias for development to said developing means.

8. An apparatus as claimed in claim 7, wherein said image transferring means comprises a belt for transferring the toner image from said image carrier to the recording medium, said pattern forming means forms, when said belt is held in contact with said image carrier, said low density pattern on said image carrier, which is not charged, by applying the bias for development to said developing means and applying a bias for image transfer to said image transferring means.

9. An image forming apparatus comprising:

an image carrier;

a drive mechanism configured to drive the image carrier;

a latent image forming mechanism configured to form a latent image on the image carrier by charging and then exposing the image carrier;

a developing mechanism configured to develop the latent image to thereby produce a corresponding toner image;

an image transferring mechanism configured to transfer the toner image form the image carrier to a recording medium;

a cleaning device which removes a developer left on the image carrier after image transfer;

a drive mode counting mechanism configured to count a duration the image carrier is driven during at least one of an image-forming mode and a non-image-forming mode, the image-forming mode defined as a mode in which an image-forming procedure is executed corresponding to a desired number of copies, and the non-image-forming mode defined as a mode in which the image-forming procedure is not executed; and a pattern forming mechanism configured to form a density pattern on at least a part of a surface of the image carrier using a period of time counted by the drive duration counting mechanism.

10. An apparatus as claimed in claim 9, further comprising a duration comparing mechanism configured to determine which of 1) the duration counted by the drive duration counting mechanism and 2) a preselected duration is greater.

11. An apparatus as claimed in claim 9, wherein the density pattern comprises a low density pattern.

12. An apparatus as claimed in claim 9, wherein the pattern forming mechanism forms the density pattern during the non-image forming mode.

13. An apparatus as claimed in claim 9, wherein the non-image forming mode includes a duration Ttotal having a natural number N of periods, each period including an interval of pattern formation, Ton, and an interval of pattern non-formation, Toff, the apparatus further comprising:

a determining mechanism configured to determine a duration of said interval of pattern formation, Ton, and a duration of said interval of pattern non-formation, Toff, according to the equations:

$$Ton=(Ttotal/N)\times d, \text{ and}$$

$$Toff=(Ttotal/N)\times(1-d)$$

where d is a duty ratio of said pattern forming means, said duty ratio defined as the ratio of Ton to the duration of one period (Ttotal/N); and means for varying said duty ratio.

14. An apparatus as claimed in claim 13, wherein in each period, the pattern forming mechanism is rendered operative first and then rendered inoperative.

15. An apparatus as claimed in claim 9, wherein said pattern forming mechanism forms the density pattern on the image carrier by applying a bias for development to the developing mechanism.

16. An apparatus as claimed in claim 9, wherein the image transferring mechanism comprises a belt for transferring the toner image from the image carrier to the recording medium, the pattern forming mechanism forms, when the belt is held in contact with the image carrier, the density pattern on the image carrier, which is not charged, by applying the bias for development to the developing mechanism and applying a bias for image transfer to the image transferring mechanism.

* * * * *